United States Patent [19]

Sakurai et al.

[11] Patent Number: 4,771,691

[45] Date of Patent: Sep. 20, 1988

[54] SHEET-FED PRESS WITH IMPRESSION CYLINDER HAVING AIR SUCTION MECHANISM

[75] Inventors: Yoshikuni Sakurai, Tokyo; Yuji Yamaguchi, Mino, both of Japan

[73] Assignee: Sakurai Machine Trading Co., Ltd., Tokyo, Japan

[21] Appl. No.: 867,357

[22] Filed: May 23, 1986

[30] Foreign Application Priority Data

| | | | |
|---|---|---|---|
| Mar. 25, 1986 | [JP] | Japan | 61-67525 |
| Mar. 25, 1986 | [JP] | Japan | 61-67526 |
| Mar. 27, 1986 | [JP] | Japan | 61-69554 |

[51] Int. Cl.[4] ..... B41F 21/00

[52] U.S. Cl. ..... 101/175; 101/217; 101/232; 101/246; 101/350

[58] Field of Search ..... 101/246, 409, 410–412, 101/232, 350, 175, 177, 137, 217, 142; 271/5, 12, 94, 99, 132, 276, 194, 196, 197

[56] References Cited

U.S. PATENT DOCUMENTS

| | | | |
|---|---|---|---|
| 2,528,123 | 10/1950 | Dyker | 101/232 X |
| 2,693,957 | 11/1954 | Welsh | 271/12 |
| 2,757,610 | 8/1956 | Gegenheimer et al. | 101/230 X |
| 4,343,241 | 8/1982 | Rudolph et al. | 271/276 X |

*Primary Examiner*—J. Reed Fisher

*Attorney, Agent, or Firm*—Jordan and Hamburg

[57] ABSTRACT

A sheet-fed press is disclosed which comprises: an ink-distribution system; a plate cylinder for supporting a plate; a paper feeding means; an impression cylinder for supporting the fed printing paper; an air passage provided in the impression cylinder; a paper attracting for attracting the printing paper which is connected to the air passage so as to hold the printing paper with the suction of the air in the air passage; and an air suction mechanism which is connected to the air passage so as to suck the air in the air passage while the means for attracting the printing paper is moved with the rotation of the impression cylinder from the position facing the leading edge portion of the printing paper at least to the printing position on the impression cylinder.

13 Claims, 8 Drawing Sheets

A: POINT IMMEDIATELY BEFORE ATTRACTION

B: ATTRACTING POINT

C: PRINTING POINT

D: RELEASE POINT

SHEET-FED PRESS WITH IMPRESSION CYLINDER HAVING AIR SUCTION MECHANISM

BACKGROUND OF THE INVENTION

The present invention relates to a small-sized sheetfed press used for job printing such as the printing of post cards and calling cards.

As such kind of small sized sheet-fed press, for example, a press shown in FIG. 16 is conventionally known. In this press, a cavity 152 is provided on the outer peripheral surface of an impression cylinder 151, and a support shaft 153 provided with a plurality of grippers 154 is reciprocatingly and rotatably disposed within the cavity 152. Each of the grippers 154 grips the leading edge of the printing paper P fed from a feed table 155 and the printing paper p is printed by means of a blanket 156*a* on a blanket cylinder 156 with the rotation of the impression cylinder 151.

In a conventional press having the above-described structure, since the leading edge portion of the printing paper p is to be a margin gripped by the grippers 154, printing on this portion is impossible. This fact that the entire surface of the printing paper cannot be effectively used is very disadvantageous especially when printing on small-sized paper. Furthermore, since the feed table 155 is ordinarily disposed such that it protrudes sideways from the impression cylinder 151, the entire size of the press is increased and it is unsuitable as a table printer. In addition, it is inconvenient in that the operation of the press must be stopped every time the printing paper is to supplied to the feed table 155.

SUMMARY OF THE INVENTION

Accordingly, it is a primary object of the present invention to provide a sheet-fed press which is capable of printing all over the surface of printing paper.

It is another object of the present invention to provide a sheet-fed press which facilitates supply of printing paper without the need for stopping the operation of the press.

It is still another object of the present invention to provide a sheet-fed press having a simple and compact structure which is capable of simultaneous two-color printing.

It is a further object of the present invention to provide a sheet-fed press which ensures that printing paper is taken out of a paper cassette without an error.

A still further object of the present invention is to provide a sheet-fed press which is capable of correctly positioning the printing paper which is taken out of a paper cassette for accurate printing.

A still further object of the present invention is to provide a sheet-fed press which facilitates cleaning of the interior and replacing of a plate and a blanket by removal of a water-distribution system.

A still further object of the present invention is to provide a water-distribution system which facilitates the control of the amount of water which is supplied to the plate.

To achieve this aim, according to a first aspect of the present invention, a sheet-fed press is provided which comprises: an ink-distribution system; a plate cylinder for supporting a plate; a paper feeding means; an impression cylinder for supporting the fed printing paper; an air passage provided within the impression cylinder; a paper attracting means for attracting the printing paper which is connected to the air passage so as to hold the printing paper on the impression cylinder with the suction of the air in the air passage; and an air suction mechanism which is connected to the air passage so as to suck the air in the air passage while the paper attracting means is moved with the rotation of the impression cylinder from the position facing the leading edge portion of the printing paper at least to the printing position on the impression cylinder.

According to a second aspect of the present invention, a sheet-fed press is provided which comprises:

an ink-distribution system; a plate cylinder for supporting a plate; an impression cylinder for supporting printing paper; a paper cassette which is provided so as to be movable in the tangential direction of the impression cylinder for accommodating a multiplicity of unprinted printing paper with one sheet laid on top of another; an air passage provided within the impression cylinder; a paper attracting means for attracting the printing paper which is connected to the air passage so as to hold the printing paper on the impression cylinder with the suction of the air in the air passage; an air suction mechanism which is connected to the air passage so as to suck the air in the air passage while the paper attracting means is moved with the rotation of the impression cylinder from the position facing the leading edge portion of the printing paper at least to the printing position on the impression cylinder; and a drive means for moving the paper cassette in the travelling direction of the paper attracting means synchronously with the rotation of the impression cylinder in the early stage of the operation of the air suction mechanism.

According to a third aspect of the present invention, a sheet-fed press is provided which comprises: an ink-distribution system; a plate cylinder for supporting a plate; a paper feeding means; an impression cylinder for supporting the fed printing paper; an air passage provided within the impression cylinder; a paper attracting means for attracting the printing paper which is connected to the air passage so as to hold the printing paper on the impression cylinder with the suction of the air in the air passage; a positioning means which is provided on the impression cylinder in the vicinity of the paper attracting means, so as to be reciprocatingly movable between an operational position which is in contact with the leading edge portion of the printing paper which is held by the paper attracting means and a non-operational position which is apart from said operational position; an air suction mechanism which is connected to the air passage so as to suck the air in the air passage while the means for attracting the printing paper is moved with the rotation of the impression cylinder from the position facing the leading edge portion of the printing paper at least to the printing position on the impression cylinder; and a drive means for moving the positioning means from the non-operational position to the operational position during the operation of the air suction mechanism.

According to a fourth aspect of the present invention, a sheet-fed press is provided which comprises: an impression cylinder for supporting printing paper; a blanket cylinder which is connected to the impression cylinder and supports a blanket for transferring ink; a plate cylinder which is connected to the blanket cylinder and supports a plate; an ink-distribution system for supplying the ink to the plate; a means for supplying water to the plate cylinder; and a means for removably supporting the means for supplying water above the plate cylinder.

According to a fifth aspect of the present invention, a sheet-fed press comprising: an impression cylinder for supporting printing paper; a blanket cylinder which is connected to the impression cylinder and supports a blanket for transferring ink; a pair of plate cylinders which are connected to the blanket cylinder and each of which supports a plate which is different from each other; a pair of inkdistribution systems each of which is connected to the respective plate cylinder and which is provided with rider rollers for transferring ink which is different from each other to the respective plate; a single water-distribution system which is disposed between the pair of inkdistribution systems and is provided with a pair of dampener ductor rollers for supplying water to the respective plate; a pair of operating means for effecting connecting and separating operations of the dampener ductor rollers with respect to the plates separately from each other; and a pair of control mechanisms for controlling the amount of water supplied to each of the plates separately from each other by controlling the connecting time of the dampener ductor rollers and the plates.

Other and further objects of this invention will become obvious upon understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

FIGS. 1 to 8 show a first embodiment of the present invention wherein

FIG. 1 is a partially broken schematic side elevational view of the entire part of a small-sized sheetfed press;

FIG. 2 is a sectional view of the peripheral portion of an impression cylinder which shows the mechanism for attracting and releasing paper;

FIG. 3 is an enlarged sectional view of the peripheral portion of the impression cylinder shown in FIG. 2, taken along the line A—A, which shows the state in which the paper is attracted;

FIG. 4 is is an enlarged sectional view of the peripheral portion of the impression cylinder shown in FIG. 2, taken along the line A—A, which shows the state in which the paper is released;

FIG. 5 is a perspective view of the water-distribution system shown in FIG. 1 in the state in which it is removed from the frame;

FIG. 6 is an enlarged sectional view of the water-distribution system shown in FIG. 5;

FIG. 7 is a partially sectional view of the water-distribution system in the state in which supply of water is stopped; and FIG. 8 is a partially sectional view of the water-distribution system in the state in which the water feed rate is set at its maximum;

FIGS. 9 to 14 show a second embodiment of the present invention having another mechanism for attracting and releasing the paper wherein FIG. 9 is a partially broken side elevational view of the impression cylinder and the paper cassette in the state immediately before the attraction of the printing paper;

FIG. 10 is a partially broken side elevational view of the impression cylinder and the paper cassette shown in FIG. 9 in the state in which the paper is attracted;

FIG. 11 is a partially broken side elevational view of the impression cylinder and the paper cassette shown in FIG. 9 in the state in which the printing paper is positioned;

FIG. 12 is a partially broken side elevational view of the impression cylinder and the paper cassette shown in FIG. 9 in which the printing paper is released;

FIG. 13 is a time chart showing the operational timing of the air sucking system, air supply device, paper cassette, sucker member and positioning member;

FIG. 14 shows a modification of the sucker member shown in FIG. 9;

DETAILED DESCRIPTION OF THE PREFERRED EMBODIMENTS

First Embodiment

Hereinunder the present invention will be explained with reference to FIGS. 1 to 8 which show a first embodiment of a small-sized sheet-fed press according to the present invention.

Figure 1:
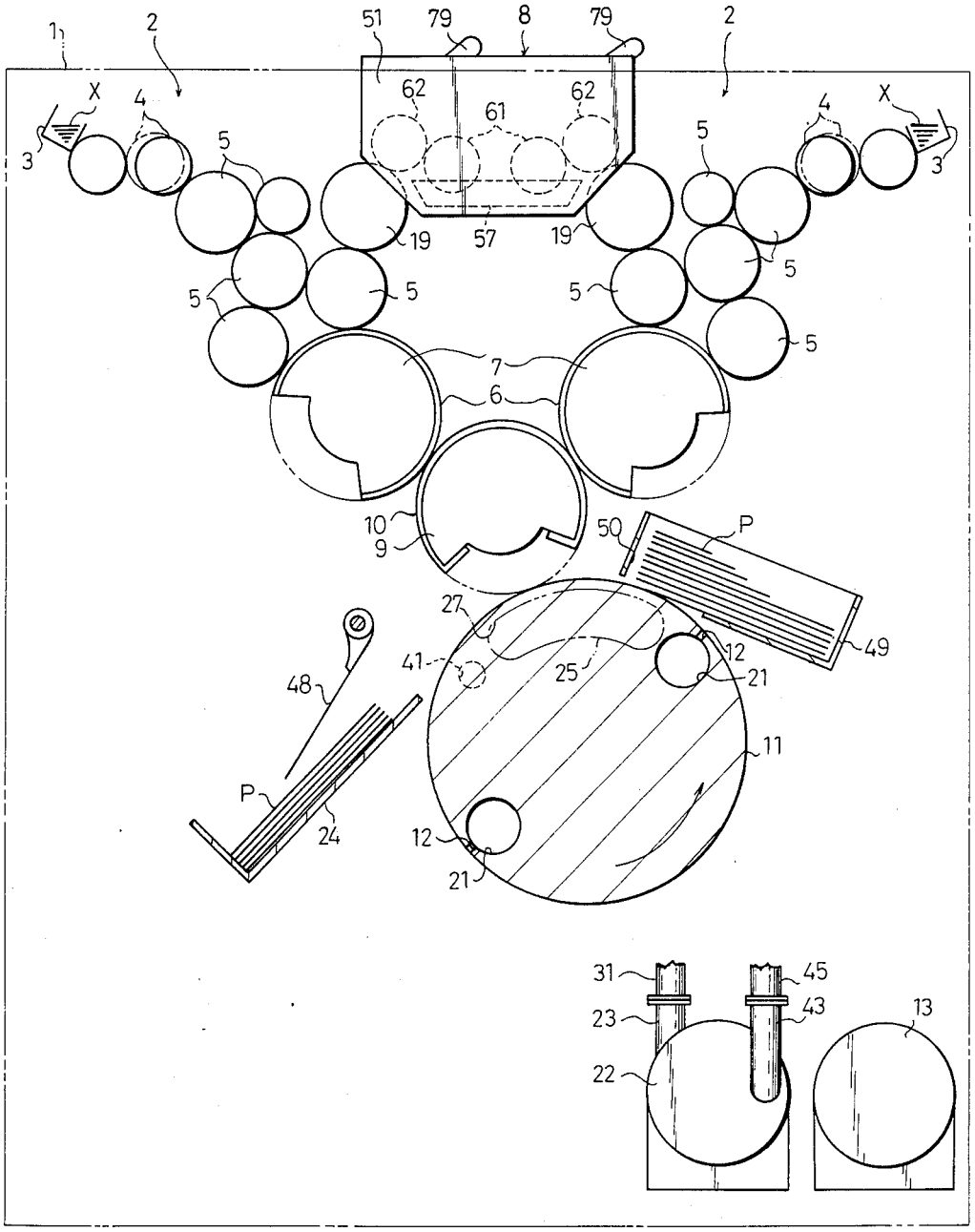

As shown in FIG. 1, a press frame 1 with the upper surface open is provided with a pair of ink-distribution systems 2 in the upper end portion. Each of the inkdistribution systems has a similar structure and is composed of an ink fountain 3 for storing ink X, a movable ink ductor roller 4 and a plurality of rider rollers 5. A pair of plate cylinders 7 are rotatably supported by the frame 1 such as to be connected to the lowermost rider roller 5, and a plate 6 is mounted on the outer peripheral surface of each of the plate cylinders 7. A water-distribution system 8 for supplying water to each plates through a dampener-form roller 19 and the rider roller 5 is disposed between the ink-distribution systems 2 at the upper end portion of the frame 1. The detailed structure of the water-distribution system 8 will be described later.

Ink X of a different color from each other is stored in each ink fountain 3, and a plate 6 of a different image from each other is mounted on each plate cylinder 7. The ink X from the ink fountain 3 is kneaded and spread with the rotation of the rider rollers 5, and is applied to the entire surface of the plate 6.

On the underside of both of the plate cylinders 7, a blanket cylinder 9 of the same size as the plate cylinder 7 is rotatably disposed so as to come into close contact with each plate cylinder 7, and on the outer peripheral surface of the blanket cylinder 9 a blanket 10 is mounted. The plates 6 are pressed against the blanket 10. With the synchronous rotations of the plate cylinders 7 and the blanket cylinder 9, the ink X on each plate 6 is transferred to the surface of the blanket 10.

An impression cylinder 11 having double the diameter of that of the blanket cylinder 9 is provided on the underside of the blanket cylinder 9 in proximity therewith. A paper cassette 49 is disposed in contact with the impression cylinder 11 such as to be situated forward in the supply direction with respect to the blanket cylinder 9. The paper cassette 49 accommodates the unprinted printing paper P with one sheet laid on top of another, and is provided with an opening 50 on the lower surface thereof for discharging the printing paper P.

The structure of the impression cylinder 11 will be explained with reference to FIG. 2. The impression cylinder 11 is formed of a metal into a cylindrical form. A support shaft 14 is protrudingly provided in the center of each end surface of the impression cylinder 11, and the end portions of both support shafts 14 are rotatably supported by the right and left frame plates 15 and 16, respectively, through respective bearing metals 17. On the outer periphery of the left end portion of the impression cylinder 11 a drive gear portion 18 is provided, and the impression cylinder 11 is rotated through a transmission mechanism (not shown) and the drive gear portion 18 when a motor 13 provided in the lower portion of the frame 1 is driven. With the rotation of the impression cylinder 11, the blanket cylinder 9, the plate cylinders 7 and the rider rollers 5 are rotated through the drive gear portion 18 and a plurality of gears (not shown).

A pair of air passages 21 are provided on the outer peripheral portion of the impression cylinder 11 such that they penetrate through the impression cylinder 11 and extend in the axial direction. Both passages are spaced at a 180° angular interval, and on both end surfaces open to the right and left end surfaces, respectively, of the impression cylinder 11. A plurality of communicating holes 12 are formed on the inner wall of each of the air passages 21 at regular intervals so as to open to the outer peripheral surface of the impression cylinder 11.

Figure 3:
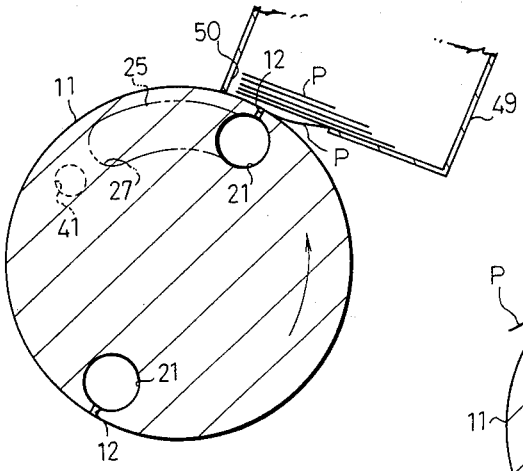

A suction flange valve 25 is placed over the support shaft 14 on the left side of the impression cylinder 11 so as to be relatively rotatable, and is pressed against the left end surface of the impression cylinder 11 by virtue of the action of a spring 26. A suction hole 27 which extends along the arc having the same center of the impression cylinder 11 and the length corresponding to that of the printing paper p is formed on the inside surface of the outer peripheral portion of the flange valve 25, as shown in FIGS. 1 and 3. A part of the suction hole 27 opens to the outer surface of the suction flange valve 25 through a connecting cylinder 28. An intake pipe 31 is connected to the connecting cylinder 28. The intake pipe 31 is inserted from an opening 30 which is formed on the left frame plate 15, and the base end of the intake pipe 31 is connected to an inlet 23 of an air processing device 22 which is provided in the lower portion of the frame 1, as shown in FIG. 1.

Figure 4:
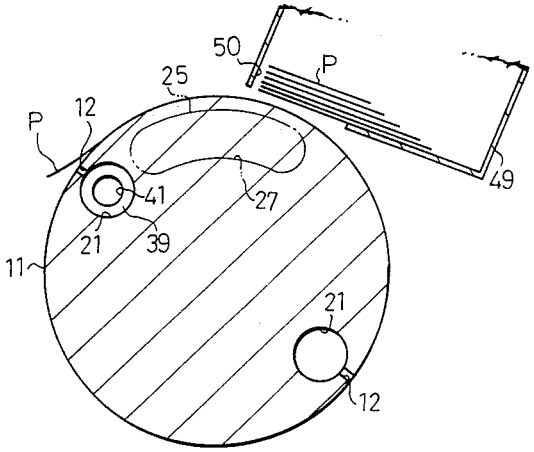

The air processing device 22, the suction flange valve 25 and the suction hole 27, etc., constitute an air suction mechanism 32, and when the communicating holes 12 which serve as a paper attracting means are opposed to the leading edge portion of the lowermost printing paper P, one end portion of the suction hole 27 is opposed to the left open end surface of the air passage 21, as shown in FIG. 3, and the air in the air passages 21 is sucked by virtue of the sucking action of the air processing device 22, whereby the printing paper P sticks to and is held by the outer peripheral surface of the impression cylinder 11 through the communicating holes 12. When the impression cylinder 11 is rotated in this sucking state, and the communicating holes 12 revolve from the suction position by the length exceeding the length of the printing paper P, as shown in FIG. 4, the left open end of the air passages 21 passes the suction hole 27 and is closed by the suction flange valve 25, whereby the sucking action at the communicating holes 12 is stopped.

Figure 2:
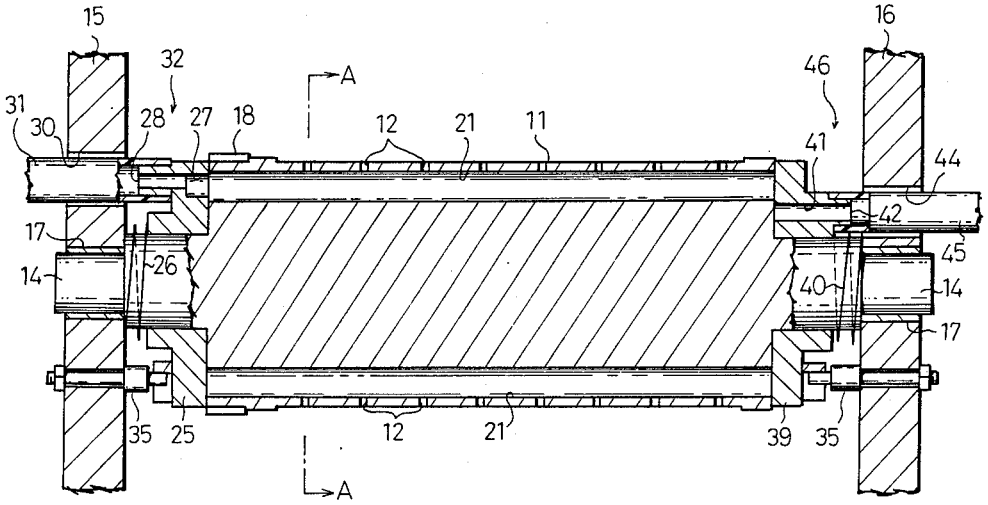

As shown in FIG. 2, a supply flange valve 39 is placed over the support shaft 14 on the right side of the impression cylinder 11 so as to be relatively movable, and is pressed against the right end surface of the impression cylinder 11 by virtue of the action of a spring 40. A circular supply hole 41 is formed on the inside surface of the outer peripheral portion of the supply flange valve 39 and a connecting cylinder 42 is protrudingly provided so as to be communicated with the supply hole 41. A supply pipe 45 which is inserted from an opening 44 formed on the right frame plate 16 is connected to the connecting cylinder 42. The end base of the supply pipe 45 is connected to an outlet 43 of the air processing device 22, as shown in FIG. 1.

The air processing device 22, the supply flange valve 39 and the supply hole 41 constitute an air supply mechanism 46. When the operation of the air suction mechanism 32 is stopped, as shown in FIG. 4, the supply hole 41 and the right open end of the air passage 21 is brought into contact with each other, and air is supplied to the air passages 21 through the supply hole 41 in accordance with the exhausting action of the air processing device 22. As a result the printing paper p is released from the outer peripheral surface of the impression cylinder 11 by the air jet from each of the communicating holes 12.

As shown in FIG. 2, an adjusting member 35 for securing the flange valves 25 and 39 to the frame 1 such that their positions are adjustable in relation to the frame is provided between the left frame plate 16 and the suction flange valve 25 and between the right frame plate 16 and the supply flange valve 39, respectively. In FIG. 1, the referential numeral 24 denotes a delivery pile, and 48 denotes a paper guide for introducing the printing paper P which is released from the impression cylinder 11 to the delivery pile 24.

Although the impression cylinder 11 has a pair of flange valves 25, 39 on the right and left sides, it is possible to provide a single flange on one side of the impression cylinder 11 which is provided with both the suction hole and the supply hole.

The operation of the small-sized sheet-fed press having the aforementioned structure will here be explained.

FIG. 1 shows the press in the state immediately before printing. A multiplicity of sheets of the printing paper P are accommodated in the paper cassette 49 with one sheet laid on top of another, and one row of the communicating holes 12 of the impression cylinder 11 is positioned immediately before the opening 50 of the paper cassette 49. At the time of the previous printing, the ink X in each ink fountain 3 of each ink-distribution system 2 and the water from the water-distribution system 8 are spread over the surface of each plate 6 of the respective plate cylinder 7, and are transferred to the surface of the blanket 10 on the blanket cylinder 9.

When the impression cylinder 11 is rotated in this state to the counterclockwise direction in FIG. 1, as viewed in FIG. 3, the left open end of the air passages 21 is brought into contact with one end portion of the suction hole 27 of the suction flange valve 25, air is sucked from the communicating holes 12 through the suction hole 27 and the air passage 21 by the sucking action of the air processing device 22, and by virtue of this sucking force the leading edge portion of the lowermost printing paper p is attracted to the outer peripheral surface of the impression cylinder 11. The printing paper P thus sticking to the surface of the impression cylinder 11 is drawn out of the paper cassette 49 with the rotation of the impression cylinder 11 and is held on the outer peripheral surface thereof. Subsequently, two-color ink X on the blanket 10 is printed on the printing paper P at the contact portion of the impression cylinder 11 and the blanket cylinder 9.

The left open end surface of the air passage 21 then comes out of contact with the other end portion of the suction hole 27 with the rotation of the impression cylinder 11, as shown in FIG. 4, and is closed by the suction flange valve 25, whereby the sucking action at the communicating holes 12 is stopped. Simultaneously with this, the right open end surface of the air passage 21 is brought into contact with the supply hole 41 of the supply flange valve 39, air is jet from the communicating holes 12 in accordance with the exhausting action of the air supply device 22, the air jetting force releasing the printing paper p from the outer peripheral surface of the impression cylinder 11.

In this manner, the printing paper P which is released from the impression cylinder 11 is collected with the rotation of the impression cylinder 11 to the delivery pile 24 through the paper guide 48 under the weight of its own gravity in the state of being prevented from floating. Thereafter, the communicating holes 12 on the other air passage 21 are situated on the underside of the paper cassette 49, a second sheet of printing paper P is drawn out of the paper cassette 49 by a similar operation to that described above, and two-color printing is conducted by the blanket 10 on the blanket cylinder 9.

According to a small-sized sheet-fed press in accordance with this embodiment, the impression cylinder 11 has a diameter two times as large as the blanket cylinder 9, and is provided with a pair of air passages 21 and, hence, a two rows of communicating holes 12. Therefore, two-color printing is conducted on two sheets of paper P per rotation of the impression cylinder 11, thereby improving the printing ability. Furthermore, since the printing paper P is safely attracted and released with the intermittent action of the air suction mechanism 32 and the air supply mechanism 46, the printing paper p is securely fed from the paper cassette 49 without any trouble even at the time of high-speed rotation of the impression cylinder 11. In addition, the supply of the printing paper P for the paper cassette 49 is conducted without stopping the operation of the press unlike the prior art paper supply which uses the feeding table.

According to the sheet-fed press of the present invention, since the printing paper p is held on the impression cylinder 11 by air, printing on the entire surface of the printing paper is enabled, which is very advantageous to job printing such as the printing of post cards. Since the paper cassette is disposed in the direction of the tangential line of the impression cylinder 11, the portion projecting from the impression cylinder is made smaller and, hence, the press itself is made smaller in size. Thus it is possible to produce a smaller-sized press which can be used as a table press.

The water-distribution system 8 will now be explained in detail.

Figure 5:
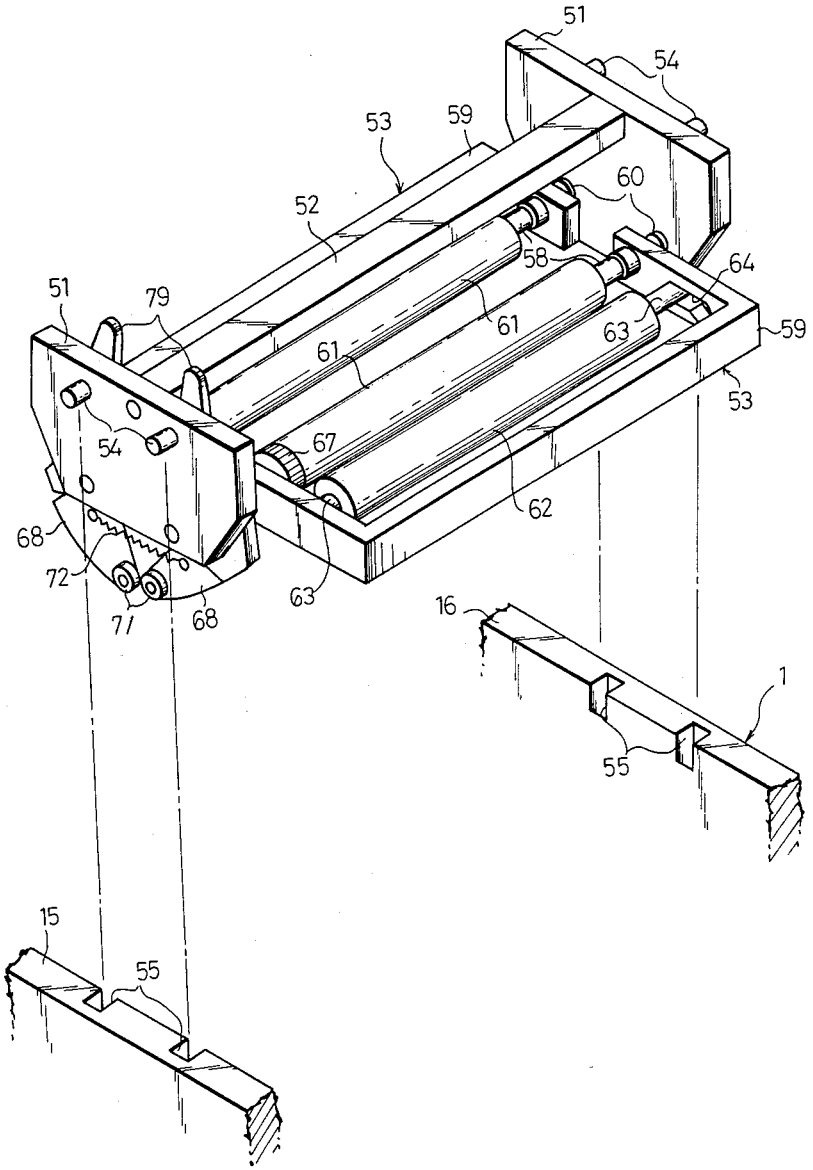
Figure 6:
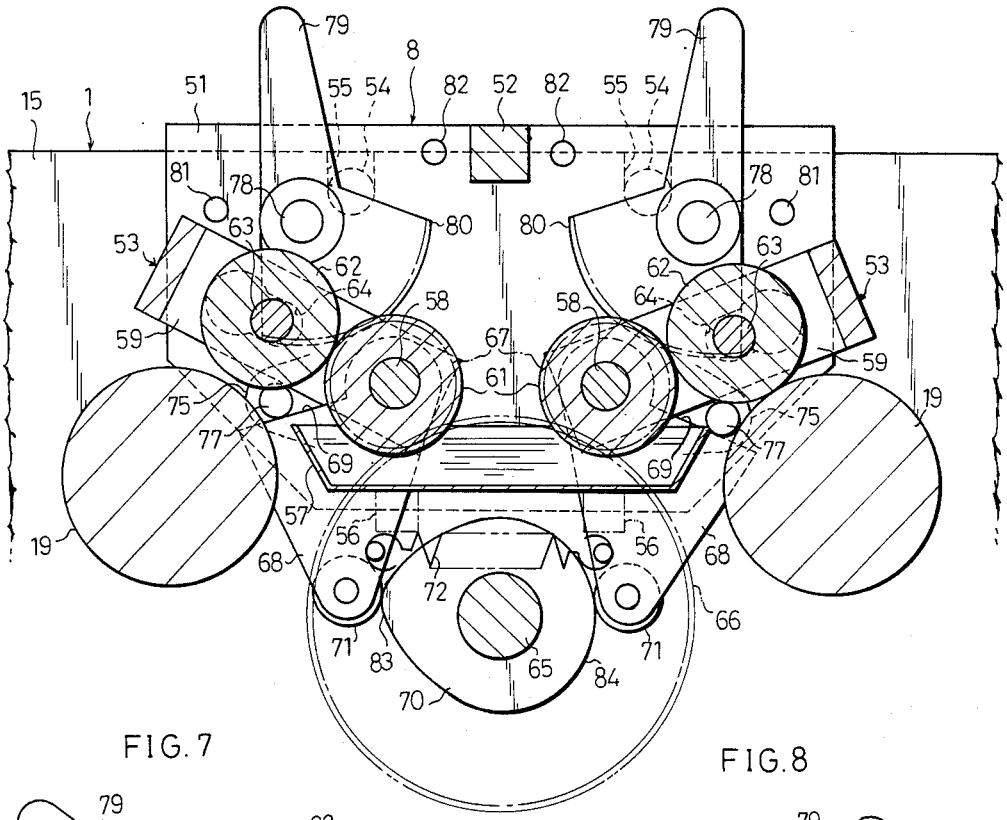

A single water-distribution system 8 for supplying water to the plates 6 on the plate cylinders 7 through the dampener-form roller 19 and the rider rollers 5 is disposed in the upper end portion of the frame 1 so as to be situated between both ink-distribution systems 2, as shown in FIGS. 1, 5 and 6. The water-distribution system 8 is composed of a pair of side plates 51, a handle 52 and a pair of roller units 53. A pair of projections 54 are secured to each of the side walls 51. A pair of recessed portions 55 for engaging the projections 54 are formed on the upper end surface of each of the frame plates 15 and 16. The water-distribution system 8 is mounted on and removed from the frame 1 by the engagement and disengagement, respectively, between the projections 54 and the recessed portions 55. On the underside of the water-distribution system 8, a water fountain 57 is removably supported through a pair of bars 56 which are secured to the frame 1.

Both roller units 53 have the same structure. Each of the roller units 53 is provided with a shaft 58 which is rotatably supported between the side plates 51. A channel-shaped support frame 59 is rotatably supported on the shaft 58 and is biased downwardly by a spring 60. A water-fountain roller 61 is placed on the shaft 58 such that the water-fountain roller 61 is constantly immersed in the water within the water fountain 58 when the water-distribution system 8 is on the frame 1. A dampener ductor roller 62 is disposed in the support frame 59 such as to be opposed to the water-fountain roller 61 from the outside, and the shaft portions 63 at both ends of the dampener ductor roller 62 are rotatably and movably supported by slots 24 which are formed on the support frame 59. When the water-distribution system 8 is mounted on the frame 1 by the engagement of the projections 54 and the recessed portion 55, the support frame 59 is inclined due to the contact between the dampener ductor roller 62 and the dampener-form roller 19, and the dampener ductor roller 62 is brought into contact with the water-fountain roller 61 by a spring (not shown).

As shown in FIG. 6, a drive gear 66 which is connected by a drive system such as the impression cylinder 11 is mounted on the inside of the frame plate 15 through a shaft 65. A driven gear 67 (see FIG. 5) is secured to the shaft 58 of the water fountain roller 61 such as to be engaged with the drive gear 66. When the water-distribution system 8 is on the frame 1, the dampener ductor roller 62 is rotated synchronously with the impression cylinder 11 through the water-fountain roller 61, the driven gear 67 and the drive gear 66, thereby delivering the water supplied from the water fountain 57 through the water-fountain roller 61 to the dampener-form roller 19.

At one end of the shaft 58 of the water fountain roller 61 a substantially triangular operating member 68 is rotatably supported at the upper end thereof. The operating member 68 has an engaging portion 69 at the position facing the lower surface of the support frame 59. The operating member 68 is also provided with a cam follower 71 which is engageable with a cam 70 which interlocks with the drive gear 66. A spring 72 is provided between the end portions of the two operating members 68 so that the cam followers 71 are engaged with the respective cams 70.

Figure 7:
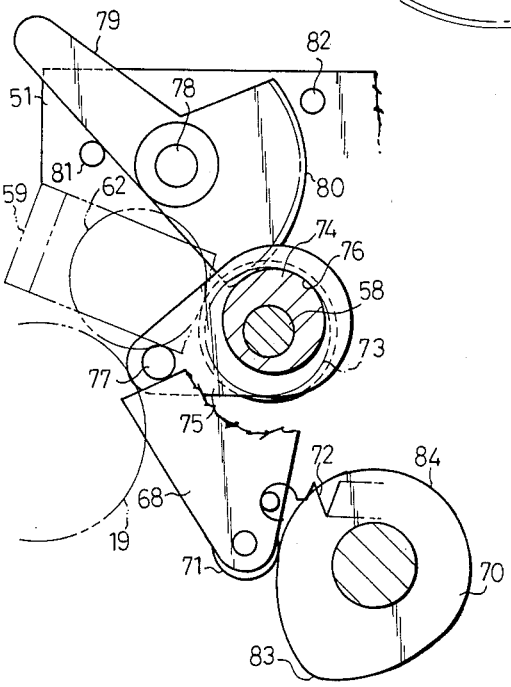
Figure 8:
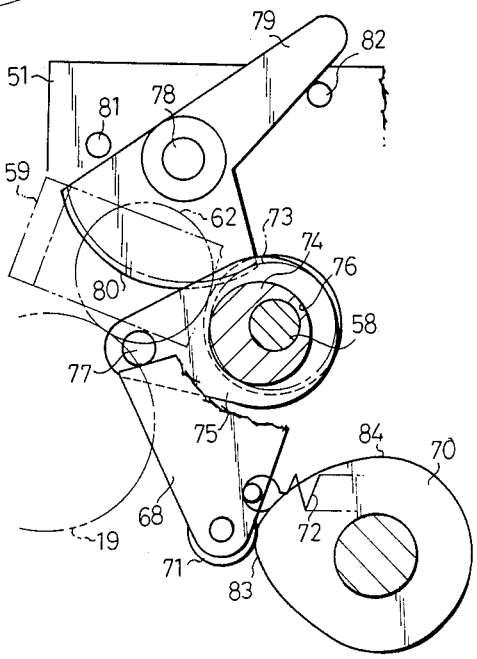

As shown in FIGS. 7 and 8, an adjusting gear 73 is secured to the shaft 58 on the outside of the driven gear 67, and an eccentric cam 74 which is eccentric with respect to the shaft 58 is secured to one surface of the adjusting gear 73. A driven member 75 is placed over the eccentric cam 74 so as to be rotatable about a hole 76 at the base end portion of the driven member 75, and at the fore end portion thereof a pin 77 is protrudingly provided so as to be clamped between the lower surface of the support frame 59 and the engaging portion 69 of the operating member 68. A driving member 79 which interlocks with the adjusting gear 73 is supported on the inside of the side plate 51 through a shaft 78 so as to be rotatable between a pair of regulating projections 81 and 82. A sector gear 80 is integrally provided with the driving member 79 at the lower end portion thereof. When the driving member 79 is rotated, the driven member 75 is moved to the rightward and leftward as viewed in FIGS. 7 and 8 through the sector gear 80, the adjusting gear 73 and the eccentric cam 74, so that the engaging position of the pin 77 with respect to the support frame 59 and the operating member 68 is adjusted as desired in the direction in which the pin 77 approaches and separates from the shaft 58.

When the driving member 79 is engaged with the one regulating projection 81, as shown in FIG. 7, the pin 77 is the closest to the shaft 58 and the relative angle between the support frame 59 and the operating member 68 is enlarged to its maximum. Therefore, in this state, wherever the cam follower 71 of the operating member 68 is engaged with the cam 70, the dampener ductor roller 62 is constantly separated from the dampener-form roller 19, whereby the supply of water to the plate 6 is stopped. On the other hand, when the driving member 79 is engaged with the other regulating projection 82, as shown in FIG. 8, the pin 77 is at the longest distance from the shaft 58 and the relative angle between the support frame 59 and the operating member 68 is reduced to its minimum. In this case, therefore, the dampener ductor roller 62 is constantly in contact with the dampener-form roller 19 irrespective of the engaging position of the cam 70, and water is continuously supplied to the plate 6. Consequently, by driving the driving member 79 to an appropriate position between the above-described two extremes, the period during which the dampener ductor roller 62 is in contact with the dampener-form roller 19 is increased or reduced on the basis of the cam profile of the cam 70, whereby the water feed rate with respect to the plate 6 is controlled. FIG. 6 shows the state in which both the driving members 79 are positioned at intermediate positions. In this case, one dampener ductor roller 62 is separated from the dampener-form roller 19 by virtue of the engagement of the cam follower 71 and a protruding surface 83 of the cam 70, and the other dampener ductor roller 62 is brought into contact with the dampener-form roller 19 by the engagement of the cam follower 71 and a substantially circular surface 84 of the cam 70. Thus, an equal amount of water is supplied from the water fountain 57 alternatively to the plates 6 during the operation of the press.

Second Embodiment

A second embodiment of the present invention will be explained with reference to FIGS. 9 to 14. A sheet-fed press in accordance with the second embodiment is different from the first embodiment in the structure of the paper cassette and the paper attracting means and it is newly provided with a means for positioning the attracted printing paper. The same numerals are provided for those elements which are the same as those in the first embodiment and explanation thereof will be omitted.

Figure 9:
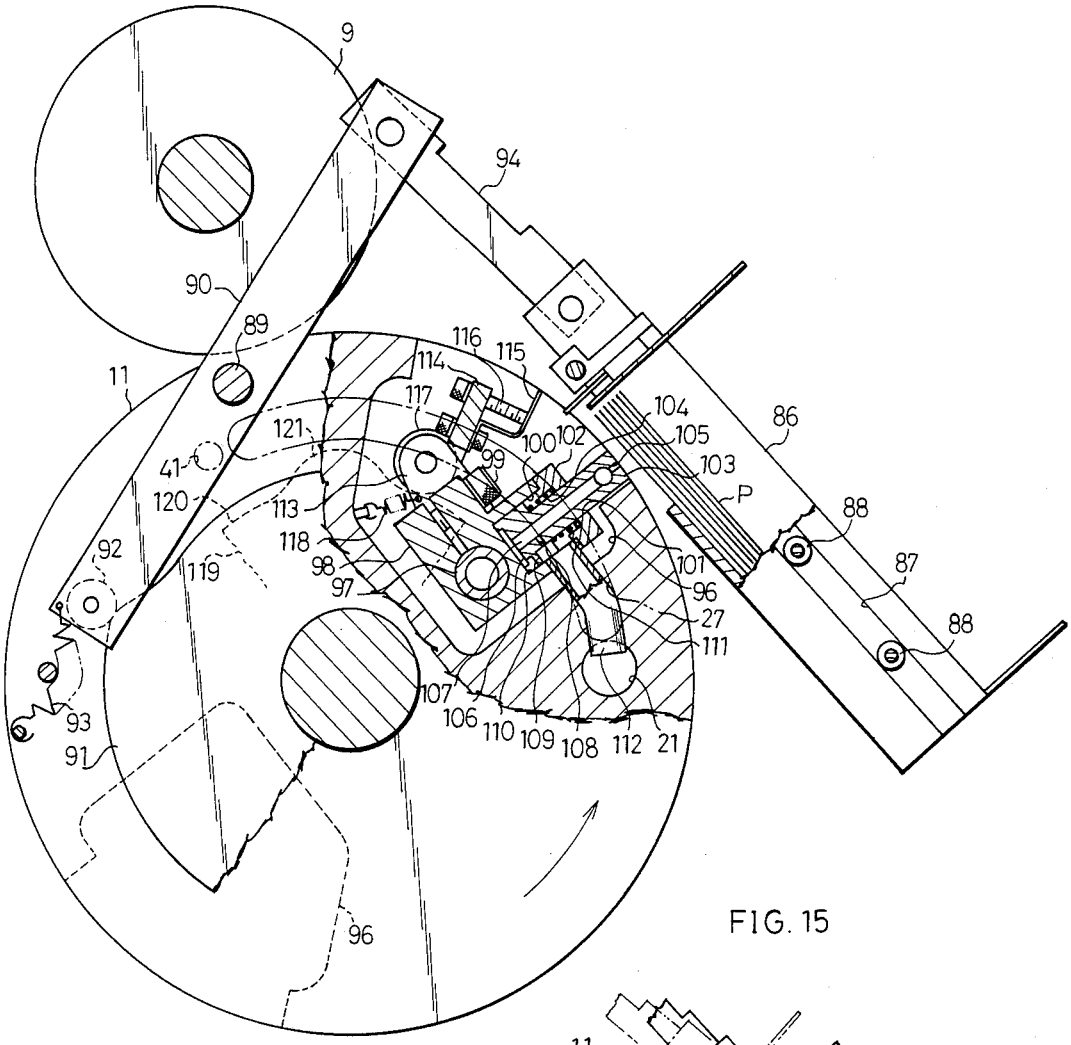

As shown in FIG. 9, a paper cassette 86 is provided with a groove 87 on both side surfaces thereof which extends in the longitudinal direction. A plurality of guide rollers 88 are protrudingly provided on the frame plates 15 and 16 so as to be engaged with the grooves 87. The paper cassette 86 is supported by the guide rollers 88 so as to be reciprocatingly movable in the direction of the tangential line of the impression cylinder 11. On a shaft 89 protrudingly provided on the inner surface of one of the frame plate, a rocking rod 90 is rotatably supported at the middle portion, and at the lower end of the rocking rod 90 a cam follower 92 is rotatably provided so as to be engaged with a cam 91 which is secured to the impression cylinder 11. Between the lower end of the rocking rod 90 and the frame plate, a spring 93 is provided so as to bias the cam follower 92 toward the cam 91. The upper end of the rocking rod 90 is connected to the end portion of the paper cassette 86 facing the blanket cylinder 9 through a connecting member 94. The paper cassette 86 is driven synchronously with the rotation of the impression cylinder 11 through the rocking motion of the rocking rod 90 based on the cam outline of the cam 91.

The impression cylinder 11 includes a pair of receiving grooves 96 spaced at a 180° angular interval, and a mounting shaft 97 is secured to the receiving groove 96 so as to extend in parallel to the axis of the impression cylinder 11. A supporting member 98 is mounted on the mounting shaft 97 through a screw 99 such that the rotation and sliding motion thereof are controllable. At the fore end portion of the supporting member 98, an accommodating chamber 100 is formed and the open end thereof is covered with a lid body 102. A sucker member 103, which is a means for attracting the printing paper p is accommodated in the accommodating chamber 100 so as to be movable in the radial direction of the impression cylinder 11, and the fore end portion of the sucker member 103 projects into the outside through a through hole 101 of the lid body 102. Ordinarily, the base end surface of the sucker member 103 is pressed against the bottom surface of the accommodating chamber 100 by the urging force of a spring 104, and in this state, the fore end surface of the sucker member 103 is situated on the outer peripheral surface of the impression cylinder 11.

The sucker member 103 is provided with an opening 105 at the fore end, a recessed portion 106 at the base end, a through hole 107 for communicating the opening 105 with the recessed portion 106, communicating holes 108 for communicating the through hole 107 with the accommodating chamber 100, and a partition piece 109 which projects at the base end side of the communicating holes 108. The partition piece 109 defines a pressure chamber 110 at the base end portion of the accommodating chamber 100, the pressure chamber 110 communicating with the recessed portion 106 of the sucker member 103. A connecting port 111 opens to the peripheral wall of the supporting member 98 which surrounds the accommodating chamber 100, and the connecting port 111 is connected to the air passage 21 by a pipe 112.

Figure 10:
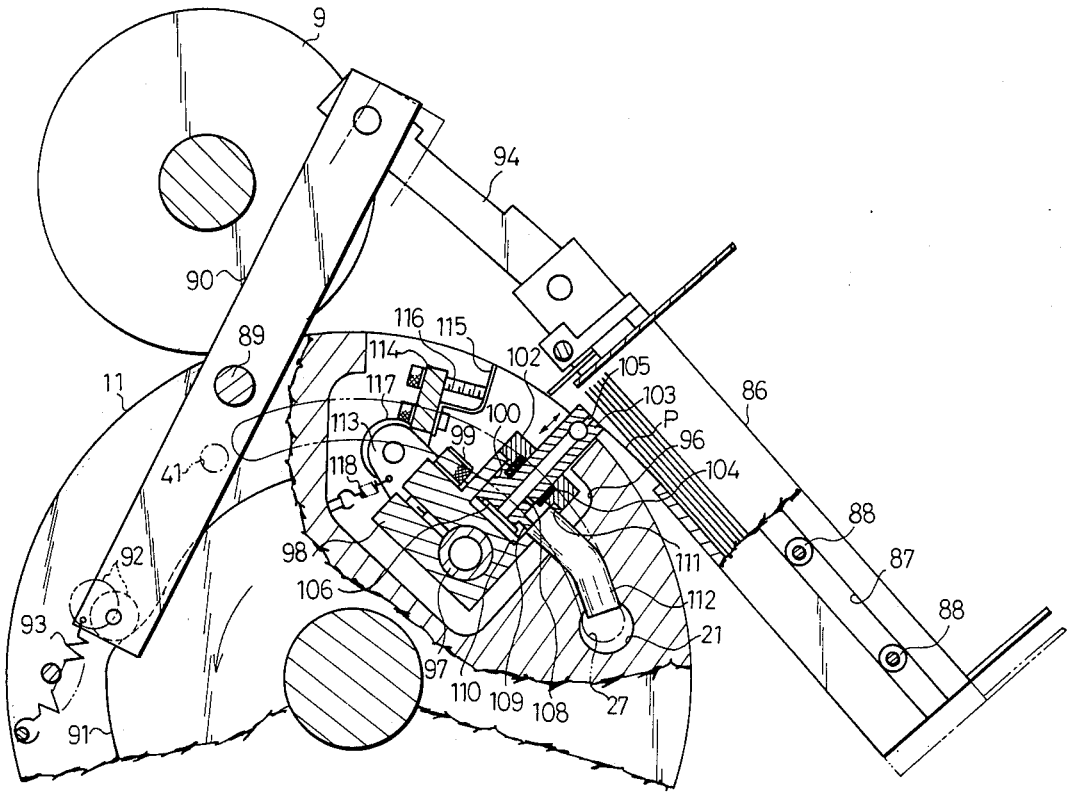

When the sucker member 103 is opposed to the fore end portion of the printing paper p in the paper cassette 86 with the rotation of the impression cylinder 11, as shown in FIG. 10, one end of the suction hole 27 of the suction flange valve 25 is brought into contact with one open end surface of the air passage 21, whereby the air in the accommodating chamber 100 is sucked through the pipe 112. The sucker member 103 protrudingly moves outwardly in resistance to the spring 104 by virtue of the difference in pressure between the reduced accommodating chamber 100 and the pressure chamber of a substantially atmospheric pressure, and the attracting surface at the fore end of the sucker member 103 approaches the printing paper p in the paper cassette 86, thereby attracting the back surface of the printing paper p by virtue of the sucked air which flows from the opening 105 to the communicating holes 108. When the opening 105 is closed by the printing paper P, the pressure in the pressure chamber 110 and the accommodating chamber 100 becomes equal, whereby the sucker member 103 moves back to its original position by the action of the spring 104 and holds the leading edge of the printing paper P on the outer peripheral surface of the impression cylinder 11. This holding state continues while the air passage 21 of the impression cylinder 11 and the suction hole 27 of the suction flange valve 25 are connected.

Figure 12:
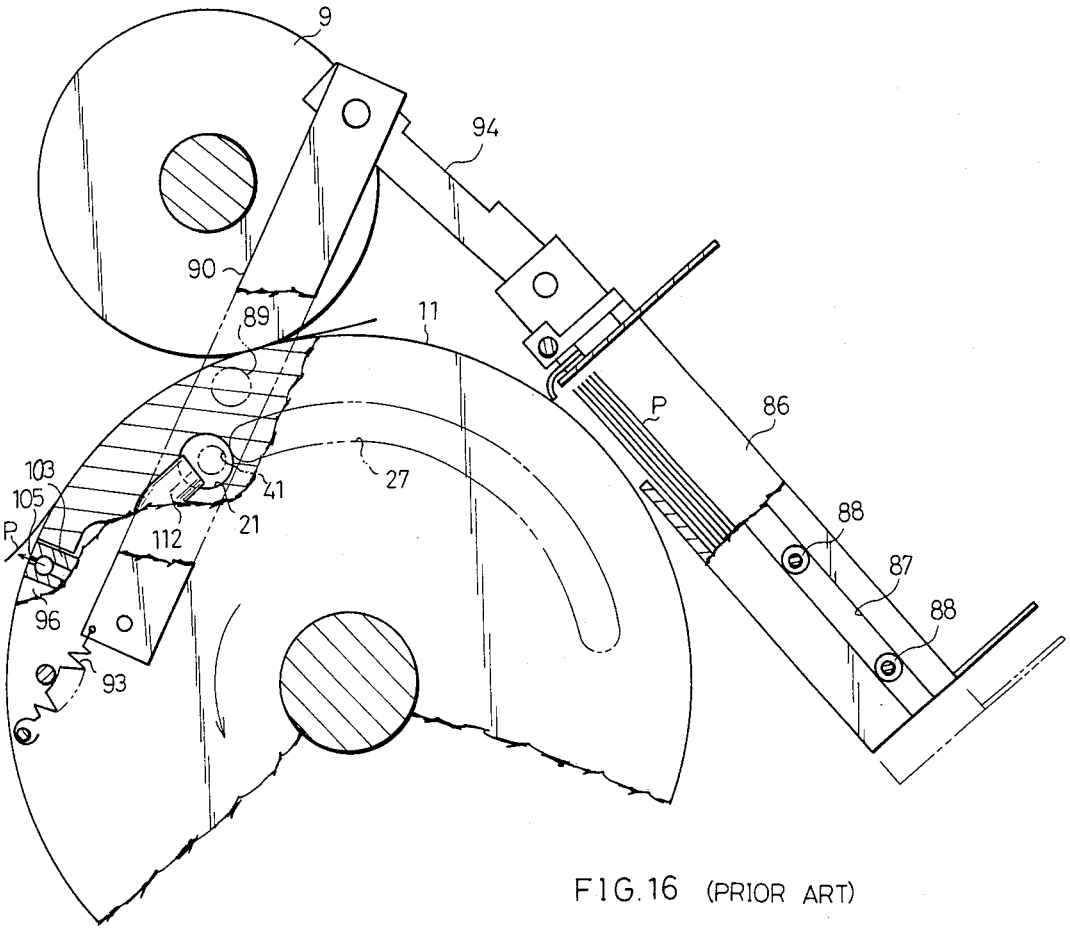
Figure 16:
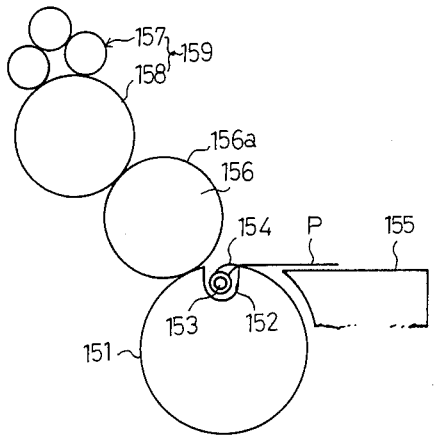
FIG. 16 (PRIOR ART)
FIG.16 is a schematic side elevational view of a conventional sheet-fed press.

On the other hand, when the sucker member 103 passes the contact point of the impression cylinder 11 and the blanket cylinder 9, and the air passage 21 passes the suction hole 27 to be connected to the supply hole 41 of the supply flange valve 39, as shown in FIG. 12, air is supplied to the accommodating chamber 100 through the pipe 112, and is expelled from the opening 105 through the communicating holes 108 and the through hole 107. By virtue of this exhaust pressure, the leading edge of the printing paper p is released from the fore end surface of the sucker member 103.

Figure 11:
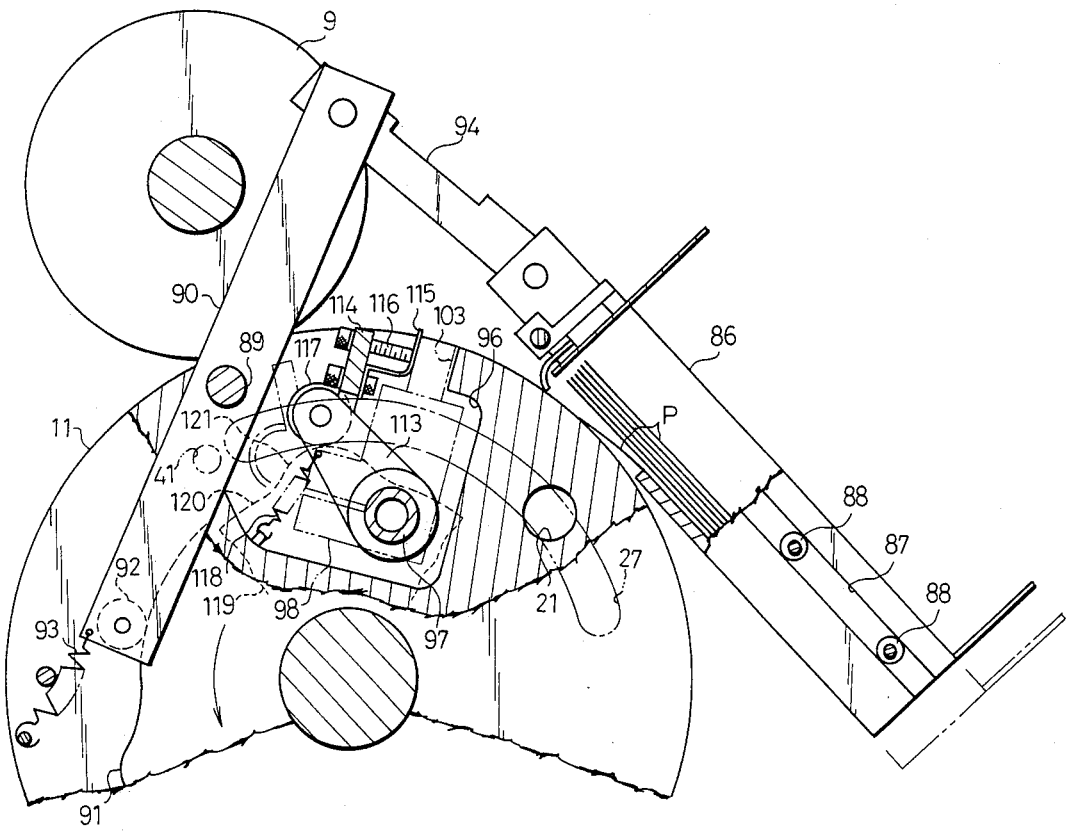

As shown in FIG. 11, a pair of arms 113 are rotatably supported by the mounting shaft 97 which is provided in the receiving groove 96 of the impression cylinder 11. A mounting rod 114 is provided between the fore end portions of the arms 113 so as to extend before the sucker member 103. On the side surface of the mounting rod 103 which faces the sucker member 103, a positioning member 115 consisting of an elastic plate is mounted such that the position of the fore end portion thereof is adjustable by a screw 116. A cam follower 117 is rotatably mounted on the fore end portion of the arm 113, and is engaged with a cam 119 fixed on the frame 1 by the action of a spring 118. When the cam follower 117 is engaged with a lower portion 120 of the cam 119, as shown in FIG. 9, the positioning member 115 is situated at a non-operational position which is forwardly separated from the sucker member 103. On the other hand, when the cam follower 117 is engaged with the higher portion 121 of the cam 119, as shown in FIG. 11, the positioning member 115 is situated at an operational position where the fore end of the positioning member 115 is brought into contact with the sucker member 103 in a state in which the positioning member 113 slightly protrudes from the outer peripheral surface of the impression cylinder 11. At this operational position, the leading edge of the printing paper P which is attracted to the sucker member 103 is positioned by the positioning member 115.

Figure 13:
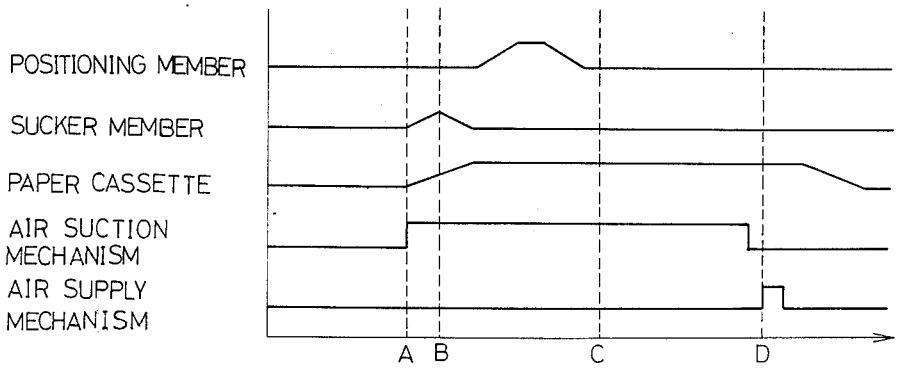

The operation of the paper feeding device having the above-described structure of the second embodiment of the present invention will be explained with reference to the time chart shown in FIG. 13.

FIG. 9 shows the paper feeding device in the state immediately before the sucker member 103 attracts the printing paper P. The paper cassette 86 is at the longest distance from the blanket cylinder 9, the sucker member 103 is in the accommodating chamber 100, and the positioning member 115 is situated at the non-operational position. When the impression cylinder 11 is rotated in this state, the air suction mechanism 32, the paper cassette 86 and the sucker member 103 start the respective operations, as indicated by the symbol A in FIG. 13. At point B in FIG. 13, the air passage 21 is connected to one end portion of the suction hole 27, and the sucker member 103 protrudes by virtue of a reduced pressure of the accommodating chamber 100, as shown in FIG. 10, thereby attracting the leading edge portion of the printing paper P to the attracting surface at the fore end portion. Immediately thereafter, the sucker member 103 moves back to its original position and the leading edge portion of the printing paper p is taken out downwardly of the opening 50 of the paper cassette 86. When taking out the paper, since the paper cassette 86 moves toward the blanket cylinder 9 in accordance with the rocking motion of the rocking rod 90 based on the cam outline of the cam 91, the printing paper p is securely caught in a state in which the sucker member 103 is relatively stopped with respect to the paper cassette 86.

At an intermediate point between the points B and C in FIG. 3, the positioning member 115 is moved from the nonoperational position and situated at the operational position. As shown in FIG. 11, when the sucker member 103 reaches before the contact point of the impression cylinder 11 and the blanket cylinder 9 with the rotation of the impression cylinder 11, the positioning member 115 comes into contact with the leading edge of the printing paper P which is attracted by the sucker member 103, through the rotation of the arm 113 based on the cam outline of the cam 119. In this way the offset of the printing paper p is eliminated, whereby the printing paper p is held accurately at a predetermined position on the impression cylinder 11. The other portion of the printing paper P is held on the impression cylinder 11 by a holding mail 95 of the paper cassette 86. The printing paper p is fed in this state to the contact point of the impression cylinder 11 and the blanket cylinder 9, where the ink on the blanket 10 is transferred to the surface of the printing paper P (point C in FIG. 13).

When the air passage 21 separates from the suction hole 27 with the rotation of the impression cylinder 11 and the suction of the sucker member 103 is stopped, the air passage 21 is immediately connected to the supply hole 41 and the printing paper p is securely released from the impression cylinder 11 by the air which is jet from the opening 105 of the sucker member 103, as shown in FIG. 12. One cycle of this operation is conducted at $\frac{1}{2}$ rotation of the impression cylinder 11. Thus two sheets of printing paper P are printed per one rotation of the impression cylinder 11, thereby enabling high-speed printing.

Figure 14:
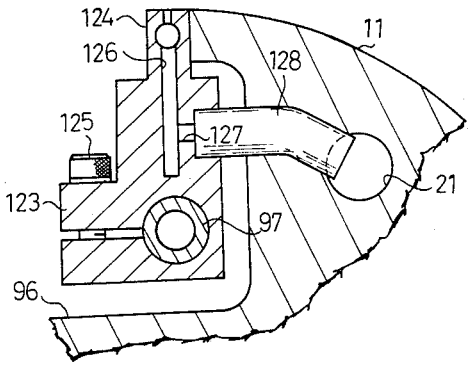

FIG. 14 shows a modification of the means for attracting paper in the second embodiment. On the mounting shaft 97 in the receiving chamber 96, a holding member 123 is fixed through a screw 125 such that the rotation and sliding thereof are controllable. Th fore end portion of the holding member 123 is integrally provided with a sucker 124. The sucker 124 has a bore 126 which opens to the outer peripheral surface of the impression cylinder 11. The bore 126 is connected to the air passage 21 through communicating holes 127 and a pipe 128. According to this modification, the structure of the paper attracting mechanism is made simpler than that of the second embodiment.

Figure 15:
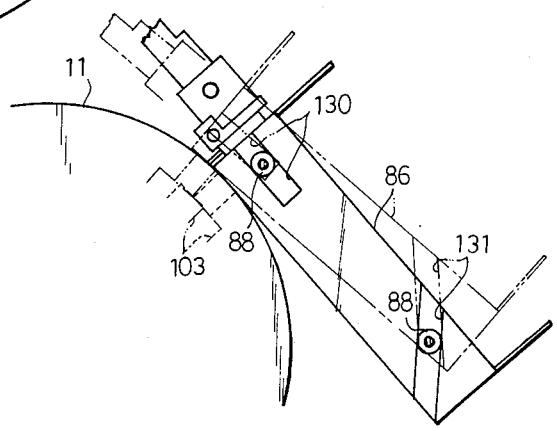
FIG. 15 is a partial side elevational view of a modification of the paper cassette support mechanism shown in FIG. 9.

FIG. 15 shows a modification of a means for supporting the paper cassette. The paper cassette 86 is provided with a front guide groove 130 and an oblique rear guide groove 131. When the paper cassette 86 moves forward synchronously with the rotation of the impression cylinder 11, the guide rollers 88 are engaged with the guide grooves 130 and 131, respectively, whereby the paper cassette 86 is slightly rotated about the front guide roller 88, so that the fore end portion thereof is prevented from coming out of contact with the sucker member 103.

As many apparently widely different embodiments of this invention may be made without departing from the spirit and scope thereof, it is to be understood that the invention is not limited to the specific embodiments thereof excepted as defined in the appended claims.

What is claimed is:

1. A sheet-fed press comprising:

an ink-distribution system;

a plate cylinder for supporting a plate;

an impression cylinder or supporting printing paper;

a paper cassette which is provided so as to be movable in the tangential direction of said impression cylinder for accommodating a multiplicity of unprinted printing paper with one sheet laid on top of another;

an air passage provided within said impression cylinder;

a paper attracting means for attracting said printing paper which is connected to said air passage so as to hold said printing paper on said impression cylinder with the suction of the air in said air passage;

an air suction mechanism which is connected to said air passage so as to suck the air in said air passage while said paper attracting means is moved with the rotation of said impression cylinder from the position facing the leading edge portion of said printing paper at least to the printing position on said impression cylinder; and a drive means for moving said paper cassette in the travelling direction of said paper attracting means synchronously with the rotation of said impression cylinder in the early stage of the operation of said air suction mechanism.

2. A sheet-fed press according to claim 1, wherein said drive means includes a cam secured to said impression cylinder; and a rocking rod which is rotatably supported at the middle portion thereof with one end provided with a cam follower which engages said cam and the other end connected to said paper cassette.

3. A sheet-fed press comprising:

an ink-distribution system;

a plate cylinder for supporting a plate;

a paper feeding means;

an impression cylinder for supporting said fed printing paper;

an air passage provided within said impression cylinder;

a paper attracting means for attracting said printing paper which is connected to said air passage so as to hold said printing paper on said impression cylinder with the suction of the air in said air passage;

a positioning means which is provided on said impression cylinder in the vicinity of said paper attracting means, so as to be reciprocatingly movable between an operational position which is in contact with the leading edge portion of said printing paper which is held by said paper attracting means and a non-operational position which is apart from said operational position;

an air suction mechanism which is connected to said air passage so as to suck the air in said air passage while said means for attracting said printing paper is moved with the rotation of said impression cylinder from the position facing the leading edge portion of said printing paper at least to the printing position on said impression cylinder; and a drive means for moving said positioning means from said non-operational position to said operational position during the operation of said air suction mechanism;

said positioning means including a fixed cam which is fixed at a predetermined position;

a mounting member which has a cam follower which is engageable with said fixed cam, and is rocked in accordance with the movement of said cam followers around an axis on said impression cylinder which is parallel to the axis of rotation of said impression cylinder; and a positioning member which is supported on said mounting member and is positioned at said operational position and non-operational position in accordance with the rocking movement of said mounting member.

4. A sheet-fed press comprising:

an ink-distribution system;

a plate cylinder for supporting a plate;

a paper feeding means for accommodating and feeding printing papers;

an impression cylinder corresponding to said paper feeding means;

an air passage within said impression cylinder;

an air suction mechanism having means for starting and stopping the application of suction to said air passage;

a paper attracting means for attracting a sheet of printing paper of said printing papers, said paper attracting means being connected to said air pasage so as to hold said printing paper on said impression cylinder with the suction of the air in said air passage, and including a supporting member provided on said impression cylinder and having a first chamber connected to said air pasasge, a sucker member accommmodated in said first chamber so as to be movable toward and away from said printing paper in said paper feeding means and having an opening connected to said first chamber and opposed to said printing paper, an urging means for urging said sucker member in a direction away from said printing paper, and an operating means for moving said sucker member toward said printing paper aganist an urging force of said urging means through air pressure in said first chamber at the start of said air suction mechanism.

5. A sheet-fed press according to claim 4, further comprising a blanket cylinder for supporting a blanket for transferring ink which is provided between said plate cylinder and said impression cylinder.

6. A sheet-fed press according to claim 5, wherein said impression cylinder has a diameter two times that of said blanket cylinder, and is provided with said air passage and said papaer attracting means at two diametrically opposite positions.

7. A sheet-fed press aocording to claim 4, further comprising a means for releasing said printing paper from said impression cylinder by expelling air from the outer peripheral surface of said impression cylinder after the operation of said air suction mechanism is stopped.

8. A sheet-fed press according to claim 4, wherein said air suction mechanism includes a valve member for so controlling that the air in said air passage is sucked while said paper attracting means is moved from the position facing the leading edge portion of said printing paper by the distance exceeding the length of said printing paper.

9. A sheet-fed press according to claim 4, wherein said paper attracting means includes communicating holes for communicating the outer peripheral surface of said impression cylinder with said air passage.

10. A sheet-fed press according to claim 4, wherein said opening is situated on the outer peripheral surface of said impression cylinder and is provided with a connecting port which is connected to said air passage and a through hole for connecting said connecting port to said opening.

11. A sheet-fed press according to claim 10, wherein said impression cylinder is provided with a holding member for fixing said sucker member and constantly positioning said opening on the outer peripheral surface of said impression cylinder.

12. A sheet-fed press according to claim 4, said paper feeding means is disposed in proximity to said impression cylinder and includes a paper cassette for accommodating a multiplicity of sheets of unprinted printing paper with one sheet laid on top of another.

13. A sheet-fed press according to claim 10 wherein said first chamber extends in a radial direction of said impression cylinder and has an open end at a side of an outer peripheral surface of said impression cylinder and a bottom surface at a side opposite said open end; said sucker member has a through hole extending in said radial direction and connected to said opening, and a partition piece on an outer surface thereof, said partition piece defining, between a surface of said first chamber and said outer surface of said sucker member, a second chamber near said bottom surface and a third chamber near said open end, said third chamber connecting said air passage with said through hole, said second chamber being connected to said through hole; whereby said sucker member is moved toward said printing paper at the start of said air suction mechanism through a difference of air pressure between said second chamber and said third chamber, and returned to its original position after sucking said printing paper through a cancellation of said difference of air pressure.

* * * * *